United States Patent [19]

Fujimori et al.

[11] Patent Number: 5,061,584

[45] Date of Patent: Oct. 29, 1991

[54] ELECTROPHOTOGRAPHIC PHOTORECEPTOR

[75] Inventors: Kenichi Fujimori, Nakakoma; Yoshitaro Nakayama, Higashiyatsushiro; Hajime Suzuki, Kofu; Yoshiko Shima, Nakakoma, all of Japan

[73] Assignees: Shindengen Electric Manufacturing Co., Ltd, Tokyo; Yamanashi Electronics Co., Ltd., Yamanashi, both of Japan

[21] Appl. No.: 451,244

[22] Filed: Dec. 15, 1989

[30] Foreign Application Priority Data

Dec. 26, 1988 [JP] Japan ..... 63-328697

[51] Int. Cl.[5] ..... G03G 5/06

[52] U.S. Cl. ..... 430/59; 430/74

[58] Field of Search ..... 430/59, 74; 546/315, 546/330

[56] References Cited

U.S. PATENT DOCUMENTS 4,751,163 6/1988 Hagiwara et al. ..... 430/59
4,839,252 6/1989 Murata et al. ..... 430/59

FOREIGN PATENT DOCUMENTS 55-42380 10/1980 Japan .
61-7840 1/1986 Japan .
61-23154 1/1986 Japan .
62-30255 2/1987 Japan .

*Primary Examiner*—John Goodrow
*Attorney, Agent, or Firm*—Stevens, Davis, Miller & Mosher

[57] ABSTRACT

An electrophotographic photoreceptor comprising a support having thereon a photosensitive layer, in which said photosensitive layer contains a butadiene compound represented by the following general formula:

[I]

wherein each of $A_1$–$A_4$, which may be the same or different, is an alkyl group, a hydrazone compound represented by the following general formula [II]:

[II]

wherein each of $B_1$ and $B_2$, which may be the same or different, is an alkyl group, a phenyl group, a benzyl group or a methoxyphenyl group, $R_1$ is hydrogen, an alkyl group or O-R in which R is a straight-chain or branched alkyl, alkenyl or alkadienyl group having from 5 to 10 carbon atoms or an aralkyl group having from 7 to 10 carbon atoms, and $R_2$ is an alkyl group, a phenyl group, a methoxy group, an ethoxy group, a benzyl group, a methoxyphenyl group, a tolyl group or a naphtyl group, and a monophenol compound. the photoreceptor is not destroyed or does not crack even when oil drops or fingerprints adhere to the photoreceptor.

4 Claims, 1 Drawing Sheet

ELECTROPHOTOGRAPHIC PHOTORECEPTOR

FIELD OF THE INVENTION

The present invention relates to an electrophotographic photoreceptor, and more particularly, to a photoreceptor using an organic photoconductive material.

RELATED ART

Generally, as photoconductive materials for electrophotographic photoreceptors, inorganic materials such as selenium (Se), cadmium sulfide (CdS), zinc oxide (ZnO) and amorphous silicons (a-Si) are used. Photoreceptors using such inorganic materials are operated such that they are charged, for example, with charging brush in the dark, subjected to imagewise exposure to selectively neutralize the charges only on the illuminated regions, thereby forming the latent electrostatic image, and then developed with developer to make the latent image visible, thereby forming the image.

Fundamental characteristics required for such electrophotographic photoreceptors are: (1) being capable of being charged to an adequate potential in the dark and (2) having a function of neutralizing the surface charge by light illumination. With respect to these characteristics, however, the aforementioned inorganic materials have both advantages and disadvantages. For instance, Se satisfies well the characteristics (1) and (2) above but it lacks flexibility and is thus difficult to convert into films. It is also sensitive to heat and mechanical shocks and thus needs cautions in handling. The amorphous silicons (a-Si) has disadvantage that it requires severe manufacturing conditions, which leads to a high manufacturing cost.

Recently, however, various photoreceptors which use organic materials eliminating the above-mentioned disadvantages have been proposed and also put to practical use. For example, Japanese Patent KOKOKU (Post-Examination Publication) No. 42380/80 and Japanese Patent KOKAI (Laid-Open) Nos. 7840/86 and 23154/86 disclose photoreceptors having hydrazone compounds contained in a charge-generating layer or a charge transfer layer, in particular. Also, Japanese Patent KOKAI (Laid-Open) No. 30255/87 discloses a photoconductive material essentially consisting of styryl compounds.

Furthermore, U.S. Pat. Nos. 4,751,163 and 4,839,252 disclose a electrophotographic light-sensitive material using butadiene compound and the photoreceptor in which a mixture of a butadiene compound and a hydrazone compound is used as a charge-transfer agent. This photoreceptor, in particular, have excellent electrophotographic characteristics. However, the dried film formed from a solution comprising a butadiene compound, a hydrazone compound and a binder has the problem that the film has a great inner stress and cracks under stimutation such as adhesion of oils and fingerprints.

OBJECT AND SUMMARY OF THE INVENTION

It is an object of the present invention to provide an electrophotographic photoreceptor in which the photoreceptor is not destroyed or does not crack even when oil drops or fingerprints adhere to the photoreceptor.

The electrographic photoreceptor according to the present invention is characterized in that said photoreceptor has a photosensitive layer containing a butadiene compound represented by the following general formula [I]:

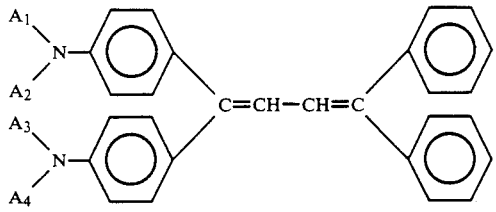

[I]

wherein each of $A_1$–$A_4$, which may be the same or different, is an alkyl group, a hydrazone compound represented by the following general formula [II]:

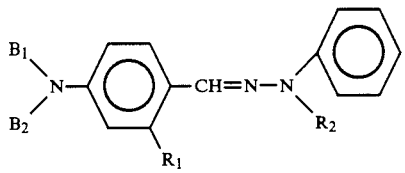

[II]

wherein each of $B_1$ and $B_2$, which may be the same or different, is an alkyl group, a phenyl group, a benzyl group or a methoxyphenyl group, $R_1$ is hydrogen, an alkyl group or O-R in which R is a straight-chain or branched alkyl, alkoxyl or alkadienyl group having from 5 to 10 carbon atoms or an aralkyl group having from 7 to 10 carbon atoms, and $R_2$ is an alkyl group, a phenyl group, a methoxy group, an ethoxy group, a benzyl group, a methoxyphenyl group, a tolyl group or a naphtyl group, and a monophenol compound.

It has now been confirmed that the film formed from a solution containing the compounds represented by general formulae [I] and [II], the monophenol compound and a binder has a reduced inner stress and does not crack under stimulation such as adhesion of oils and fingerprints.

BRIEF DESCRIPTION OF THE DRAWINGS

Each of FIGS. 1 and 2 is a sectional view of an electrophotographic photoreceptor according to the present invention.

DETAILED DESCRIPTION OF THE PREFERRED EMBODIMENT

Figure 1:
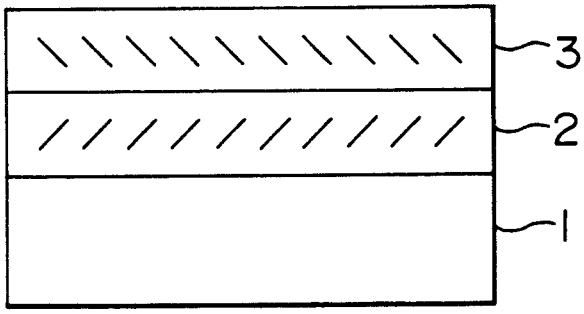

Preferred specific examples of the budadiene compounds of general formula [I] are those of general formula [I] in which every one of $A_1$–$A_4$ is a methyl group or an ethyl group, that is to say,

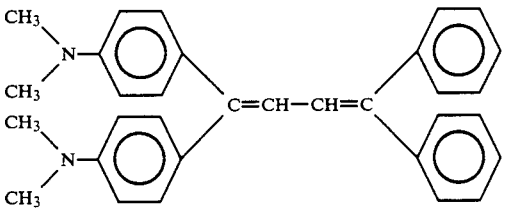

(1)

1,1-bis(p-dimethylaminophenyl)-4,4-diphenyl-1,3-butadiene and

-continued (2)

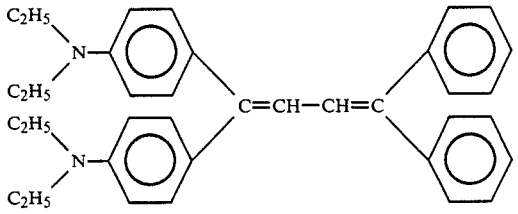

1,1-bis(p-diethylaminophenyl)-4,4-diphenyl-1,3-butadiene.

Preferred specific examples of the hydrazone compounds of general formula [II] are those of general formula [II] in which both $B_1$ and $B_2$ are methyl groups, ethyl groups, benzyl groups or phenyl groups, or $B_1$ is a benzyl group and $B_2$ is a methoxyphenyl group, $R_1$ is hydrogen, a methyl group, a methoxy group or a benzyloxy group and $R_2$ is a methyl group, a phenyl group or a benzyl group, that is to say, (3)

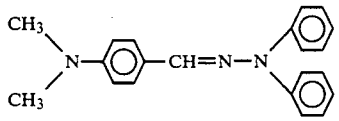

p-dimenthylaminobenzaldehyde-(diphenylhydrazone), (4)

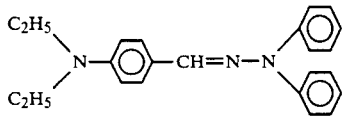

p-diethylaminobenzaldehyde-(diphenylhydrazone), (5)

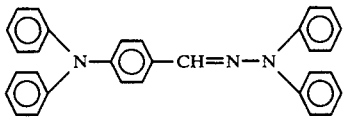

p-diphenylaminobenzaldehyde-(diphenylhydrazone), (6)

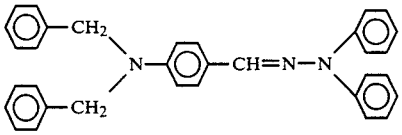

p-dibenzylaminobenzaldehyde-(diphenylhydrazone), (7)

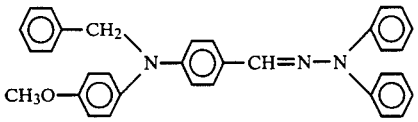

p-(benzyl-methoxyphenyl)aminobenzaldehyde-(diphenylhydrazone), (8)

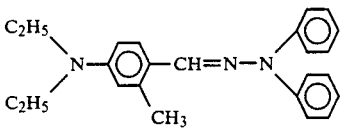

o-methyl-p-diethylaminobenzaldehyde-(diphenylhydrazone),

-continued (9)

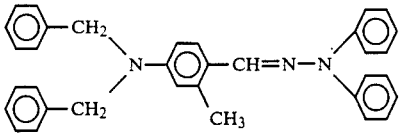

o-methyl-p-dibenzylaminobenzaldehyde-(diphenylhydrazone), (10)

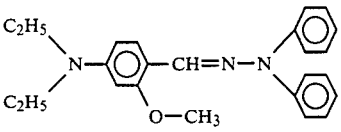

o-methoxy-p-diethylaminobenzaldehyde-(diphenylhydrazone), (11)

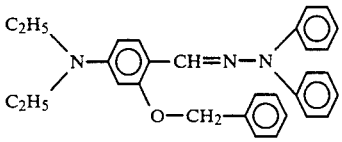

o-benzyloxy-p-diethylaminobenzaldehyde-(diphenylhydrazone), (12)

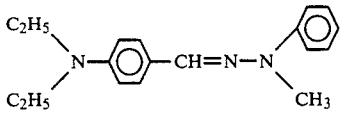

p-diethylaminobenzaldehyde-(methyl-phenylhydrazone), (13)

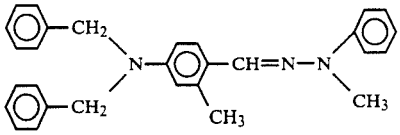

o-methyl-p-dibenzylaminobenzaldehyde-(methyl-phenylhydrazone), and (14)

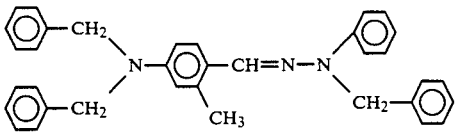

o-methyl-p-dibenzylaminobenzaldehyde-(benzyl-phenylhydrazone.

These butadiene compounds and hydrazone compounds have been known before the filing of the present patent application. For instance, the butadiene compounds can be prepared by the method described in the above-mentioned Japanese Patent KOKAI (Laid-Open) No. 30255/87, and the hydrazone compounds can be prepared by the method described in the above-mentioned Japanese Patent KOKAI (Laid-Open) Nos. 7840/86 and 23154/86.

Preferred specific examples of the monophenol compounds include the following compounds:

2-tert-butyl-4-methoxyphenol,
2,6-di-tert-butylphenol,
2,6-di-tert-butyl-4-methylphenol,
2,6-di-tert-butyl-4-ethylphenol and
2,6-di-tert-butyl-4-methoxyphenol.

These compounds, in general, are known as antioxydants.

However, such compounds can suprisingly suppress the occurrence of cracks due to adhesion of oils and fingerprints without deteriorating the performance of photoreceptors.

Antioxidants and light stabilizers other than the monophenol antioxidants (the above monophenol compounds), such as those used in plastics, for example, bisphenol antioxidants, polyphenol antioxidants, amine antioxidants, salicylic acid light stabilizers and benzophenone light stabilizers have been tried to use in place of the monophenol antioxidants. However, the polyphenol antioxidants are ineffective for preventing cracks caused by adhesion of oils and fingerprints. The use of the bisphenol antioxidants, the amine antioxidants, the salicylic acid light stabilizers and the benzophenone light stabilizers prevents cracks but increases the residual potential so that the performance of photoreceptors is deteriorated.

Figure 2:
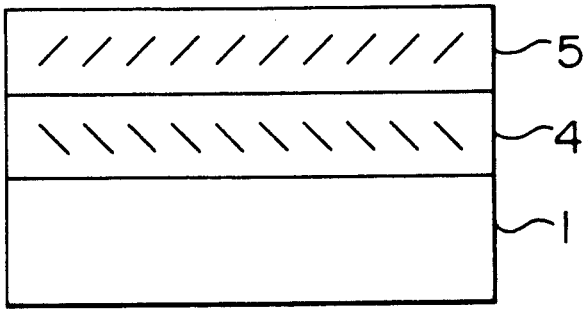

The electrographic photoreceptor according to the present invention may have the structures as shown in FIGS. 1 and 2. FIG. 1 shows a separately functioning double-layer structure of negatively charging mode, which comprises a support 1, a charge-generating layer 2 on the support 1, and a charge transfer layer 3 on top. FIG. 2 shows a double-layer structure of positive charging mode, which comprises a support 1 having a charge-transfer layer 4 thereon and a charge-generating layer 5 on top.

The photoreceptor according to the present invention may, if desired, have an additional charge-transfer layer on the top layer.

The photoreceptor according to the present invention may be manufactured by applying on a conductive support a coating solution obtained by dissolving a butadiene compound [1,1,4,4-tetraphenyl-1,3-butadiene compound] represented by the above-mentioned general formula [I], a hydrazone compound represented by the above-mentioned general formula [II] and a monophenol compound together with a binder in a suitable solvent and drying the coating solution to form a photosensitive layer, usually 5 to 30 μm thick. The coating solution may optionally contain photoconductive materials which absorb light to generate charge, sensitizing dyes, electron absorbable materials and plasticizers.

In the case of the structure comprising the charge-generating layer 2 and the charge-transfer layer 3 in FIG. 1, the above-mentioned coating solution is applied on the charge-generating layer 2 comprising the photoconductive material dispersed in the binder. In the case of the structure shown in FIG. 2, the charge-generating layer 5 is formed on the charge-transfer layer 4 formed by applying the above-mentioned coating solution to the support 1. The amount added of a mixture of the butadiene compound and the hydrazone compound is in the range of from 20 to 200 parts by weight, preferably from 30 to 150 parts by weight per 100 parts by weight of the binder. The ratio, in the mixture, of the butadiene compound to the hydrazone compound is such that the hydrazone compound is in the range of from 10 to 4,000 parts by weight, preferably from 50 to 3,000 parts by weight per 100 parts by weight of the butadiene compound. The amount of the monophenol compound is 5 to 20% by weight of the total weight of the butadiene compound and the hydrazone compound. For the charge-generating layer applied in the present invention may be used the known photoconductive materials alone or in combination, for example, the inorganic materials such as Se, Se-Te alloys, Se-As alloys, CdS and ZnO; phthalocyanines containing metals such as Cu, Al, In, Ti, Pb and V; and the organic materials such as metal-free phthalocyanines, chlorodiane, azo pigments, blue pigments, bis-azo pigments and cyanine pigments, and the electrical insulating binders which may be used alone or in combination include thermoplastics such as polyesters, polycarbonates, polyacrylates and polyamides, thermosetting resins such as epoxy, urethane and silicone resins, photocurable resins, poly-N-vinyl-carbazole. The solvents which can be used for the preparation of the coating solution include ethers such as tetrahydrofuran and dioxane; ketones such as methyl ethyl ketone and cyclohexanone; aromatic hydrocarbons such as toluene and xylene; and chlorinated hydrocarbons such as dichloroethane and chloroform. The conductive supports which can be used include aluminum and nickel which have been converted into sheets or drums; plastic films with the surfaces which have been vacuum-deposited or plated with metals such as aluminum, copper and nickel; and plastic materials mixed with conductive powders such as carbon and fabricated into the form of sheet or drum.

The present invention will be described in greater detail with reference to the following examples.

EXAMPLE 1

Titanyl phthalocyanine was heated at a degree of vacuum of $10^{-6}$ mmHg and vacuum-deposited on an aluminum drum in the thickness of 0.2 μm to form a charge-generating layer. A coating solution consisting of 100 parts by weight of polycarbonate Z (manufactured by Mitsubishi Gas Kagaku Company), 10 parts by weight of butadiene compound (2) of the aforementioned general formula [I], 1,1-bis(p-diethylaminophenyl)-4,4-diphenyl-1,3-butadiene, 90 parts by weight of hydrazone compound (9) of the aforementioned general formula [II], o-methyl-p-dibenzylaminobenzaldehyde-(diphenylhydrazone), 10 parts by weight of 2,6-di-tert-butyl-4-methylphenol and 500 parts by weight of chloroform, was applied onto the charge-generating layer by a spraying or dipping method to form on 20 μm thick charge-transfer layer and dried at 80° C. for one hour in the air to prepare a photoreceptor of this example.

EXAMPLE 2

A photoreceptor of this example was prepared in the same manner as in Example 1 but using hydrazone compound (3), p-dimethylaminobenzaldehyde-(diphenylhydrazone), in place of hydrazone compound (9) and using 2,6-di-tert-butyl-4-methoxyphenol in place of 2,6-di-tert-butyl-4-methylphenol.

COMPARATIVE EXAMPLE 1

A photoreceptor of this comparative example was prepared in the same manner as in Example 1 but using a coating solution free of 2,6-di-tert-butyl-4-methylphenol.

COMPARATIVE EXAMPLE 2

A photoreceptor of this comparative example was prepared in the same manner as in Example 1 but using 2,2'-methylene-bis(4-methyl-6-tert-butylphenol) in place of 2,6-di-tert-butyl-4-methylphenol.

COMPARATIVE EXAMPLE 3

A photoreceptor of this comparative example was prepared in the same manner as in Example 1 but using pentaerythritol-tetrakis[3-(3,5-di-tert-butyl-4-hydroxyphenyl)propionate] in place of 2,6-di-tert-butyl-4-methylphenol.

COMPARATIVE EXAMPLE 4

A photoreceptor of this comparative example was prepared in the same manner as in Example 1 but using N-phenyl-1-naphtylanine in place of 2,6-di-tert-butyl-4-methylphenol.

COMPARATIVE EXAMPLE 5

A photoreceptor of this comparative example was prepared in the same manner as in Example 1 but using salicylic acid-p-tert-butylphenol in place of 2,6-di-tert-butyl-4-methylphenol.

COMPARATIVE EXAMPLE 6

A photoreceptor of this comparative example was prepared in the same manner as in Example 1 but using 2-hydroxy-4-methoxy-benzophenone in place of 2,6-di-tert-butyl-4-methylphenol.

The drum photoreceptors prepared in the above examples and comparative examples were stained by adhesion of oils and fingerprints and negatively charged with a discharge of −5 KV to measure their electrophotographic characteristics. The results are shown in Table 1 below.

TABLE 1

| | (1) Vo (V) | (2) Efo (μ J/cm²) | (3) DDR1 | (4) Vol (V) | (5) VR1 (V) | (6) Vo2 (V) | (7) VR2 (V) | (8) DDR2 | (9) Presence of Cracks |
|---|---|---|---|---|---|---|---|---|---|
| Example 1 | 700 | 0.5 | 0.9 | 700 | 50 | 690 | 50 | 0.85 | no |
| Example 2 | 700 | 0.6 | 0.9 | 700 | 50 | 690 | 60 | 0.85 | no |
| Comparative Example 1 | 600 | 0.5 | 0.9 | 700 | 50 | 690 | 50 | 0.85 | yes |
| Comparative Example 2 | 700 | 0.6 | 0.9 | 700 | 90 | 700 | 100 | 0.86 | no |
| Comparative Example 3 | 700 | 0.6 | 0.9 | 700 | 70 | 700 | 100 | 0.86 | yes |
| Comparative Example 4 | 650 | 0.6 | 0.9 | 700 | 80 | 700 | 100 | 0.85 | no |
| Comparative Example 5 | 750 | 0.7 | 0.9 | 700 | 120 | 720 | 150 | 0.83 | no |
| Comparative Example 6 | 700 | 0.7 | 0.9 | 700 | 150 | 720 | 200 | 0.83 | no |

(1) Surface charge (05 KV).
(2) Half-valve exposure (at 650 V and 780 nm)
(3) Dark decay ratio (initial, in 10 seconds)
(4) Initial charge potential,
(5) Dark decay ratio (after 200 cycles: in 10 seconds)
(6) Charge potential after 200 cycles
(7) Residual potential after 200 cycles
(8) Initial residual potential
(9) Naked eye observation after 48 hrs from adhesion by oils and fingerprints The results in Table 1 indicate that:

(1) The photoreceptor of Comparative Example 1 prepared without using any antioxidant cracks owing to adhesion of oils and fingerprints.

(2) The photoreceptor of Comparative Example 3 prepared using an antioxidant other than monophenol antioxidant cracks.

(3) The photoreceptors of Examples 1 and 2 and of Comparative Examples 2, 4, 5 and 6 do not crack even when oils and fingerprints adhere to them. However, with respect to the electrophotographic characteristics the photoreceptors of Examples 1 and 2 have no problem but the photoreceptors of Comparative Examples 2 and 6 show high residual potential and increase the residual potential by cyclic operation. These tendencies are particularly remarkable with the photoreceptors of Comparative Examples 5 and 6.

Electrophotographic photoreceptors may be stained by adhesion of oils and fingerprints and thereby crack. Such stained photoreceptors become of no use. Accord ing to the present invention, the photoreceptor is pro vided which avoids the aforementioned problem an has inherent characteristics as they are.

What is claimed is:

1. An electrophotographic photoreceptor comprisin a support having thereon a photosensitive layer, i which said photosensitive layer contains a butadien compound represented by the formula:

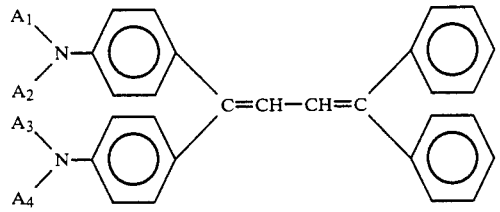

wherein each of $A_1$–$A_4$, which may be the same o different, is an alkyl group, a hydrazone compound represented by the formula:

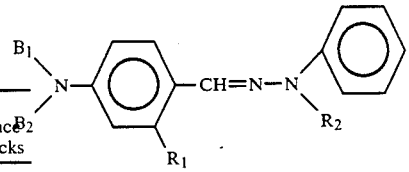

wherein each of $B_1$ and $B_2$, which may be the sam or different, is an alkyl group, a phenyl group, benzyl group or a methoxyphenyl group, $R_1$ i hydrogen, an alkyl group or O-R in which R is straight-chain or branched alkyl, alkenyl or alka dienyl group having from 5 to 10 carbon atoms o an aralkyl group having from 7 to 10 carbon atom and $R_2$ is an alkyl group, a phenyl group, a me thoxy group, an ethoxy group, a benzyl group, methoxyphenyl group, a tolyl group or a naphthy group, and a monophenol compound selected from the group consisting of 2-tert-butyl-4-methoxyphenyl, 2,6-di-tert-butylphenol, 2,6di-tert-butyl-4-methlphenol, 2,6-di-tert-butyl-4-ethylphenol and 2,6-di-tert-butyl-4-methoxyphenol.

2. The electrophotographic photoreceptor according to claim 1, wherein the butadiene compound is 1,1-bis(p-diethylaminophenyl)-4,4-diphenyl-1,3-butadiene.

3. The electrophotographic photoreceptor according to claim 1, wherein the hydrazone compound is selected from the group consisting of p-dimethylaminobenzaldehyde(diphenylhydrazone), o-methyl-p-dibenzylaminobenzaldehyde(diphenylhydrazone) and o-benzyloxy-p-diethylaminobenzaldehyde-(diphenylhydrazone).

4. The electrophotographic photoreceptor according to claim 1, wherein the amount of the monophenol compound is 5 to 20% by weight of the total weight of the butadiene compound and the hydrazone compound.

* * * * *